US005571548A

United States Patent [19]

Lynch et al.

[11] Patent Number: 5,571,548

[45] **Date of Patent: *Nov. 5, 1996**

[54] PRESSURIZED BEVERAGE PACKAGE WITH AN INTERIOR COMPARTMENT FOR THE PRODUCTION OF FOAM ON OPENING OF THE PACKAGE, AND A METHOD OF FORMING SUCH A PACKAGE

[75] Inventors: Francis J. Lynch, Dublin, Ireland; Derek C. Lockington, Whissendine; Robert Purdham, West Hendon, both of Great Britain

[73] Assignee: Guiness Brewing Worldwide Limited, London, United Kingdom

[ * ] Notice: the term of this patent shall not extend beyond the expiration date of Pat. No. 5,514,393.

[21] Appl. No.: 146,000

[22] Filed: Nov. 1, 1993

[30] Foreign Application Priority Data

Nov. 10, 1992 [GB] United Kingdom ..... 9223519

[51] Int. Cl.[6] ..... B65B 31/00; B65B 17/00; B65B 25/00

[52] U.S. Cl. ..... 426/112; 426/115; 426/124; 426/131; 426/132; 206/222; 220/501; 220/553; 220/906

[58] Field of Search ..... 426/112, 115, 426/124, 131, 106, 397, 398, 394, 474, 477; 53/420, 432, 433, 471, 474; 206/222; 220/501, 553, 906

[56] References Cited

U.S. PATENT DOCUMENTS

| | | | |
|---|---|---|---|
| 4,279,938 | 7/1981 | Hildebrand | 426/424 |
| 4,832,968 | 5/1989 | Forage et al. | 426/112 |
| 5,062,548 | 11/1991 | Hedderick et al. | 222/190 |
| 5,196,216 | 3/1993 | Lynch et al. | 426/112 |
| 5,203,140 | 4/1993 | Jamieson | 53/432 |
| 5,514,393 | 5/1996 | Lynch et al. | 426/112 |

OTHER PUBLICATIONS

Webster's 3rd New International Dictionary, P. Gove, Ed., G&C Merriam Co., Springfield Mass., 1961, p. 162.

Derwent Abstract, abstracting WO publication WO9100825-A.

*Primary Examiner*—Esther Kepplinger
*Assistant Examiner*—Curtis E. Sherrer
*Attorney, Agent, or Firm*—McCormick, Paulding & Huber

[57] ABSTRACT

A beverage package and a method of forming such a package has a can 1 within a primary chamber 5 of which is located an insert 6 having a secondary chamber 10. The insert has a seating in the form of a bore 11 within which is received the lower end of a tube 15. The tube 15 is fitted to the insert whilst the latter is positioned in the can. When the can is charged with beverage such as beer 20 having gas in solution and sealed to form a headspace 21 containing gas at a pressure greater than atmospheric, beer from the chamber 20 may fill the tube 15. The secondary chamber 10 contains gas at a pressure greater than atmospheric and on opening the container the headspace 21 de-pressurises causing beverage and/or gas from the secondary chamber to be ejected through the tube 15 and such ejection causes froth to be developed in the headspace 21. The tube 15 isolates a major part of the beer in the container from having its gas liberated so that such gas can evolve gradually to provide sparkle in the beer when the latter is poured into a glass. The tube is preferably press fitted into the socket 11. In an alternative arrangement the tube may be received on a spigot extending from the insert 6. Preferably the seating 11 is co-axial with a cylindrical can 1 and the tube 15 is curved to locate its upper end adjacent to the side wall 3 of the can.

12 Claims, 3 Drawing Sheets

PRESSURIZED BEVERAGE PACKAGE WITH AN INTERIOR COMPARTMENT FOR THE PRODUCTION OF FOAM ON OPENING OF THE PACKAGE, AND A METHOD OF FORMING SUCH A PACKAGE

BACKGROUND OF THE INVENTION

The present invention relates to a beverage package and a method of forming such a package. More particularly it concerns beverages containing gas, such as carbon dioxide and/or nitrogen, in solution and packaged in a sealed container which, when opened for dispensing or consumption, causes gas to be evolved or liberated from the beverage to form, or assist in the formation of, a head of froth on the beverage. The beverages to which the invention relates may be alcoholic or non-alcoholic; primarily the invention was developed for fermented beverages such as ale, lager, stout or other beer and cider but may be applied with advantage to so-called soft drinks and beverages, or alcoholic drinks such as spirits, liquers, wine and the like.

DESCRIPTION OF PRIOR ART

Beverage packages are known which comprise a sealed container having a primary chamber containing the beverage having gas in solution and forming a primary headspace comprising gas at a pressure greater than atmospheric and in which a secondary chamber containing gas at a pressure greater than atmospheric has a restricted orifice which communicates with the beverage in the primary chamber. Upon opening the package to dispense the beverage, the primary headspace is opened to atmospheric pressure and this creates a pressure differential within the container which causes gas and/or beverage in the secondary chamber to be ejected by way of the restricted orifice into the beverage in the primary chamber. The ejection of the gas or beverage from the secondary chamber and through the restricted orifice causes gas in solution in the beverage to be evolved for froth formation. Examples of beverage packages having the latter characteristics are disclosed in our U.S. Pat. No. 4,832,968 (where it is preferred that beverage is ejected from the secondary chamber for the purposes of froth development) and our British Patent No. 1,266,351 (where gas is ejected from the secondary chamber, possibly through a non-return valve, for the purposes of froth development).

Our aforementioned prior Patents discuss the manner in which it is believed that gas in solution in the beverage is caused to be evolved to develop a desirable head of froth on the beverage by the ejection of gas and/or liquid from the secondary chamber through the restricted orifice. This technique for froth development is now well known in the art.

In the known beverage packages of the kind discussed above the restricted orifice is located at or towards the bottom of the beverage in the primary chamber. When the package is opened and gas and/or liquid/beverage is ejected through the restricted orifice, gas in solution is initially evolved in the region of the beverage which is local to the restricted orifice and this evolution of gas develops or grows rapidly to rise throughout the volume of beverage in the primary chamber to develop a head of froth which is retained when the beverage is dispensed from the container. For some beverages, particularly those containing carbon dioxide in solution (with or without nitrogen gas in solution) it is possible for a major part, if not all, of the gas in solution to be evolved from the beverage shortly after the gas or beverage has been ejected from the secondary chamber on opening the package. As a consequence, when the beverage is dispensed from the container into a drinking glass for consumption, it is possible that the absence, or low level, of gas in solution in the beverage will impart undesirable characteristics to the beverage (albeit that such beverage may have a good quality head of froth). This is particularly the case for so-called light beers or lagers where it is preferred that a reasonable volume of gas, usually carbon dioxide, is retained in solution in the beverage as dispensed in a drinking glass so that such gas can evolve naturally to rise as minute bubbles within the beverage and the latter retains a "sparkle" which is considered desirable aesthetically and can add to the consumer's enjoyment and "mouth feel" of the beverage. It is an object of the present invention to provide a beverage package of the kind generally discussed which alleviates the aforementioned disadvantage of excessive liberation of gas in solution so that the beverage when dispensed will retain a desirable "sparkle" without detracting from the desirable characteristics required for froth development in forming a head on the beverage. It is also an object to provide a beverage package of the kind generally discussed and which lends itself to a relatively simple method of formation that may be regarded as economically viable for production of the packages at a relatively high rate in a commercial installation.

SUMMARY OF THE INVENTION

According to the present invention there is provided a method of forming a beverage package which comprises providing an open topped container with a primary chamber and a secondary chamber in which the secondary chamber contains gas at a pressure greater than atmospheric or gas at a pressure greater than atmospheric will develop in the secondary chamber, the primary chamber opens to the open top of the container, and the secondary chamber communicates, or is intended to communicate, with the primary chamber through a port; inserting a tube into the primary chamber and sealing one end of the tube for communication with the secondary chamber through said port with the second end of the tube opening into the primary chamber at a position remote from the bottom of the container; charging the primary chamber with beverage having gas in solution, and sealing the open top of the container to provide a primary headspace therein with a pressure greater than atmospheric. Preferably beverage with which the primary chamber is charged is caused to enter the tube through the second end thereof.

Further according to the present invention there is provided a beverage package comprising a sealed container having a primary chamber containing beverage having gas in solution therewith and forming a primary headspace comprising gas at a pressure greater than atmospheric; a secondary chamber containing gas at a pressure greater than atmospheric and having a seating which receives one end of a tube extending within the primary chamber so that the second end of the tube opens into the primary chamber at a position remote from the bottom of the primary chamber and said one end of the tube communicates or is to communicate with the secondary chamber for the secondary chamber to communicate with the primary chamber by way of the tube, and wherein said package is openable to open the primary headspace to atmospheric pressure and said opening creates a pressure differential causing gas and/or beverage in the secondary chamber and tube to be ejected by way of the tube into the primary chamber to cause evolution of gas from solution in the beverage for developing froth in the primary headspace.

Still further according to the present invention there is provided a beverage package comprising a sealed container having a primary chamber containing beverage having gas in solution therewith and forming a primary headspace comprising gas at a pressure greater than atmospheric; a secondary chamber containing gas at a pressure greater than atmospheric, said secondary chamber communicating or being intended to communicate with the primary chamber by way of a tube which is sealed relative to the secondary chamber and which extends upwardly within the primary chamber to open into that chamber at a position remote from the bottom of the beverage in the primary chamber, said package being openable to open the primary headspace to atmospheric pressure and said opening creates a pressure differential causing fluid comprising gas and/or beverage in the secondary chamber to be ejected by way of the tube into the primary chamber and said ejection causes gas to be evolved from beverage in the container for forming froth in the primary headspace, and wherein said tube provides a restriction to the fluid flow therethrough during said ejection for effecting the evolution of gas from the beverage.

Usually the secondary chamber will be located at or towards the bottom of the container with the one end of the tube fitted and sealed to the seating of the secondary chamber so that the tube extends upwardly within the primary chamber towards the top of the container for the second end of the tube to open at a relatively high level in the primary chamber. The second, or upper, end of the tube may open into the beverage in the primary chamber or into the primary headspace (in the latter case when the tube expels froth or beverage from which gas is evolved on opening of the package). During charging of the primary chamber with beverage or subsequent to such charging and sealing of the container (for example by inversion or other handling of the sealed beverage package) beverage can enter the tube through its second end and possibly enter the secondary chamber by flow through the tube. By the proposal of the present invention the seating of the secondary chamber may be pre-formed so that the tube may simply be inserted into the container through the primary chamber thereof for its one, bottom, end to be engaged and sealed with the seating, conveniently as a press-fit.

Although the secondary chamber may be built-in as an integral part of the container, it is preferred that the secondary chamber is provided within an insert that is located in the primary chamber of the container. Such inserts are now well known in the art and are typically formed as or from plastics moldings which are received within the primary chambers of the containers through the open tops and located at a position on or adjacent to the bottom of the respective containers. The insert may be retained in position as an interference fit with a side wall of the container, by suction, magnetically or otherwise. With such a plastics molded insert the seating with which the tube is to be engaged may readily be pre-formed so that, in an installation for commercial production of the beverage-packages at a relatively high rate, inserts may be successively fitted into primary chambers of successive containers and thereafter tubes inserted into the containers to engage with the seatings of the respective inserts. This latter arrangement is particularly advantageous as it permits conventional fitting of the inserts to the containers without hinderance from the tubes (as could occur if the inserts carry the tubes as they are being fitted in to the containers).

The aforementioned insert for the secondary chamber may be received by the open topped container with the secondary chamber sealed and containing gas at a pressure greater than atmospheric so that the tube when fitted to its seating communicates through its second end with a closed port of the secondary chamber; this port is maintained closed as the container is charged with its beverage and subsequently sealed. However during subsequent processing of the sealed package, for example as a result of the package being heated for pasteurising the beverage, the structure of the insert may be modified, for example by thermal distortion of the plastics of the insert, to ensure that when the sealed package is opened and the pressure differential applied, communication is effected, possibly by way of a non-return valve in the insert, between the secondary chamber and the primary chamber by way of the port and the tube. Preferably however, the insert is of the kind discussed in our U.S. Pat. No. 4,832,968 and is received by the container with the secondary chamber open to communication with atmosphere by way of the port for the tube seating. With this preferred form of insert, when the tube is fitted thereto and the primary chamber charged with beverage and the container sealed with the primary headspace at a pressure greater than atmospheric, the secondary chamber will be pressurised by way of its communication through the tube with the primary chamber as the contents of the sealed container come into equilibrium.

Usually the container will initially be in the form of an open topped cylindrically walled can and with such cylindrical containers it is preferred that the seating with which the one end of the tube engages for communication with the secondary chamber is located co-axial with the cylindrical wall so that the tube may be inserted through the open top of the can and its one end displaced along the axis of the can to be presented axially for direct engagement with the seating of the secondary chamber. This latter arrangement is particularly advantageous, especially where the secondary chamber is provided by an insert as aforementioned, as it alleviates possible difficulties in otherwise having to orientate the container to present the seating correctly for engagement by the tube or to orientate the insert rotationally within the container to ensure that the seating for connection to the tube is appropriately positioned to receive the tube, for example by automatic tube fitting apparatus where a probe carrying the tube may enter the primary chamber through the open top of the container to feed the one end of the tube axially into engagement with the seating.

The primary purpose of the tube is to ensure that when the sealed package is opened and a pressure differential is developed between the atmospheric pressure in the primary headspace and the greater pressure in the secondary chamber, the ejection of fluid (gas and/or beverage) from the tube at a relatively high level in the primary chamber causes gas in solution in the beverage to be evolved from what may be regarded as a relatively small proportion of the total volume of beverage in the container to develop a froth in the primary headspace. As a consequence, a desirable proportion of gas, typically carbon dioxide, can be maintained in solution in a reasonably large proportion of the total volume of beverage in the container. Therefore when the beverage is dispensed into a drinking glass or other container, usually for consumption, gas may continue to evolve from solution to maintain "sparkle" and other characteristics considered desirable for the beverage product.

The liberation of gas in solution from the beverage in the development of froth is believed to be caused by the injection into the beverage of gas and/or beverage under pressure or by the ejection of beverage which results from the pressure differential that is developed between the secondary chamber and the primary chamber when the sealed container is opened. For such liberation it is generally considered that the gas and/or beverage injection or beverage ejection is effected through a restriction and preferably such restriction is provided at the port through which the secondary chamber communicates with the one end of the tube. With this latter arrangement the injection of gas and/or beverage from the secondary chamber by way of the restricted port into beverage in the tube can cause gas in solution to be liberated from the restricted volume of beverage in the tube so that froth may emerge from the second end of the tube into the primary headspace or to "seed" the development of further froth by the liberation of gas in solution from beverage at a relatively high level in the primary chamber. A further possibility for liberating gas in solution in the beverage to develop froth is for the tube to have a bore of sufficiently small diameter so that the aforementioned restriction is effectively provided by the bore of the tube itself and as beverage is ejected from the tube under the effect of the differential pressure caused when the container is opened, gas in solution is liberated from the beverage for froth development.

The seating of the secondary chamber with which the tube engages may be in the form of a tubular spigot which is received as a sealing press fit within the one end of the tube—such an arrangement may be particularly convenient where the secondary chamber is formed as an insert which is initially received by the container as a sealed unit (so that the sealed secondary chamber contains gas at a pressure greater than atmospheric as previously discussed) and with an initially closed port communicating with the bore of the tubular spigot whereby when the port opens on opening of the container gas under pressure is injected through the port and into beverage in the tube and/or in the primary chamber for the purpose of froth formation. Alternatively the seating may be in the form of a socket within which part length of the tube adjacent to its one end is received as a sealing press fit. This latter arrangement is preferred where the secondary chamber is formed by an insert which is received by the container with the secondary chamber at atmospheric pressure and communicating through a port with the primary chamber similar to the proposal in our U.S. Pat. No. 4,832,968 as previously discussed; the latter port can provide the socket within which the tube is to be fitted. An advantageous feature of the tube and socket fitting is that the tube may be press fitted so that its face at the one end is at a predetermined position with respect to an opposing wall of the insert to form a restriction to fluid flow from the secondary chamber to the tube. This restriction may serve to provide injection of gas and/or beverage from the secondary chamber into beverage in the tube to effect liberation of gas from solution in the beverage and promote froth development or to effect liberation of gas from solution in beverage which is forced through the restriction from the secondary chamber to promote the development of froth.

Preferably the tube is arranged to extend from the seating of the secondary chamber so that its second (upper) end is located adjacent to, and preferably directed towards, a side wall of the container. This is conveniently achieved by pre-forming the tube of plastics so that it curves over its longitudinal extent and when the one end of the tube is fitted to the seating of the secondary chamber which is located co-axially with a cylindrical container, the curvature of the tube locates its second or upper end adjacent to the cylindrical wall of the container. It will be appreciated that when the sealed container is opened and the primary headspace reduces to atmospheric pressure, the pressure differential which is created between the primary headspace and the secondary chamber will cause froth, beverage and/or gas to be ejected from the second, upper, end of the tube and by locating that end of the tube adjacent to the side wall of the container the likelihood of fluid being jetted through an aperture formed by opening the top of the container, (for example by a conventional openable tag or ring pull) is alleviated.

BRIEF DESCRIPTION OF THE DRAWINGS

Two embodiments of a beverage package constructed in accordance with the present invention will now be described, by way of example only, with reference to the accompanying illustrative drawings, in which.

DESCRIPTION OF PREFERRED EMBODIMENTS

Figure 1:
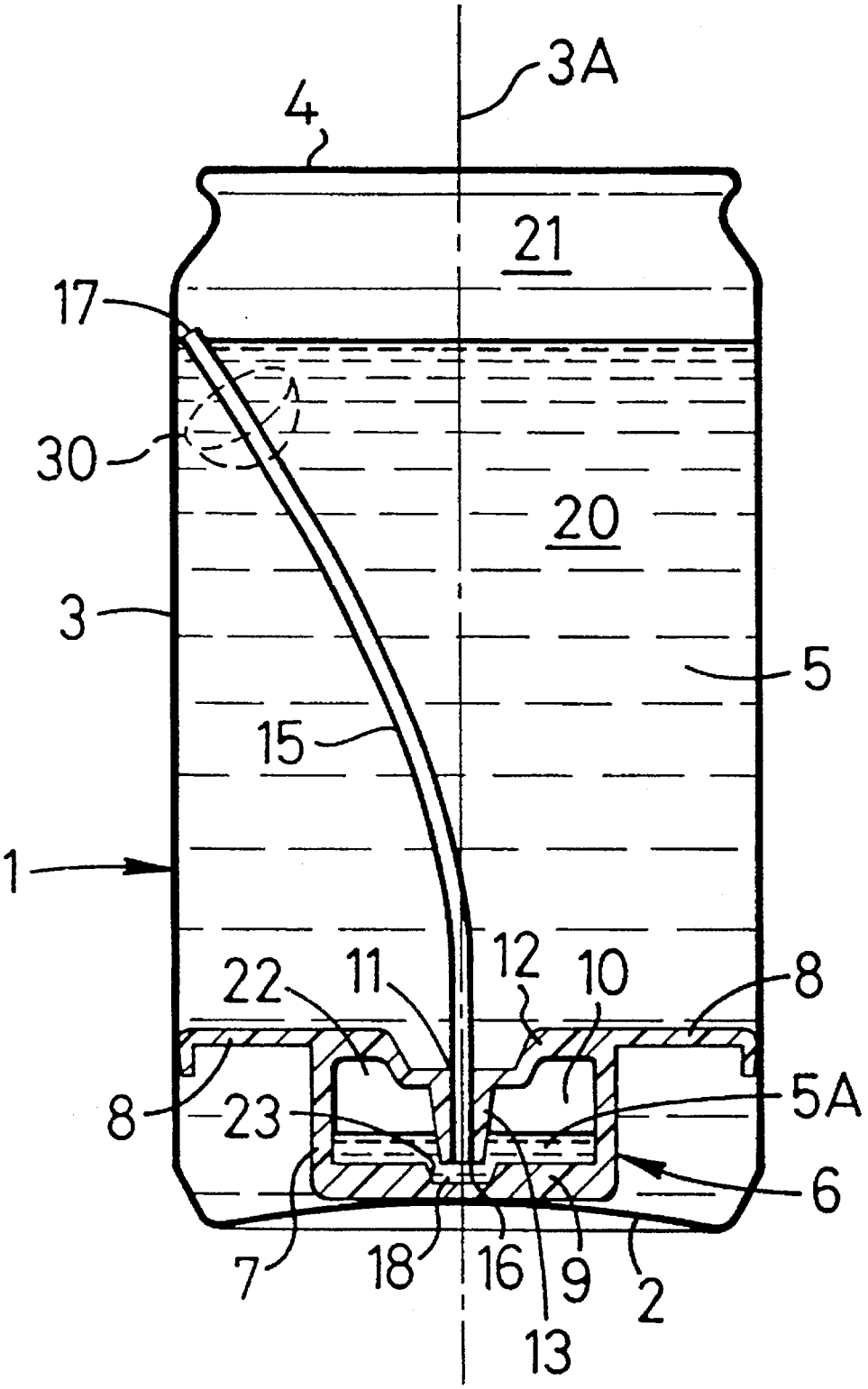
FIG. 1 shows a section through a first embodiment of the package in which the tube is fitted in a socket seating in an insert forming the secondary chamber.

The beverage packages illustrated comprise a conventional form of container such as a light metal can 1 having an externally concave circular base 2 on which the package will normally stand, a cylindrical side wall 3 and a circular top 4 which will usually be seamed to the side wall 3 to seal the container. The top 4 will be openable, typically by a ring pull, displaceable tab or other conventional means for the purpose of dispensing beverage contents of the container.

In the present example the beverage for the package may be considered as a light beer or lager having in solution a mixture of carbon dioxide and nitrogen gases, typically the carbon dioxide content will be 1.75 to 6.0 grammes per liter and the nitrogen gas content will be 3% to 5% vols./vol. The term "vols./vol" is well known in the art but a definition of it may be found in our U.S. Pat. No. 4,279,938.

The container 1 forms a primary chamber 5 and prior to fitting and sealing the top 4 and with the container in an upstanding condition, an insert 6 is inserted into the primary chamber through the open top of the container and located on the base 2 at the bottom of the primary chamber.

Figure 2:
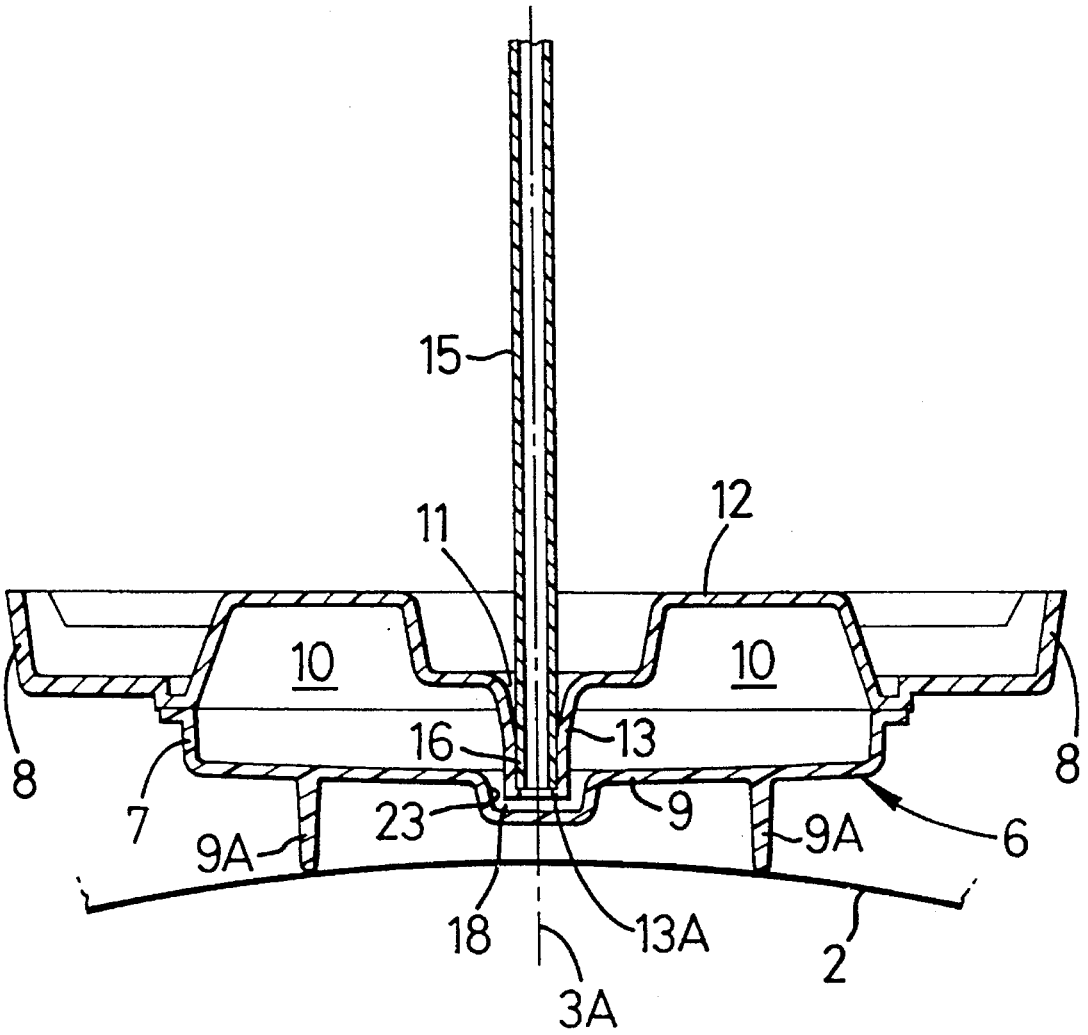
FIG. 2 is an enlarged sectional view of the insert and tube fitted thereto shown in FIG. 1.

The insert 6 is conveniently assembled from plastics mouldings to have a hollow generally cylindrical drum 7 from which extend diametrically opposed flanges 8. The insert is fitted within the container so that the flanges 8 frictionally engage with the cylindrical side wall 3 to retain a bottom wall 9 of the hollow drum 7 (or a flange 9A extending from the bottom wall 9 as shown in FIG. 2) on the base 2 of the container and position the hollow drum 7 substantially co-axial with the axis 3A of the side wall 3. The hollow drum 7 of the insert forms a secondary chamber 10. In the embodiment of FIGS. 1 and 2 the secondary chamber 10 of the insert as received by the container communicates with the primary chamber 5 by way of a port 11 in an upper wall 12 of the drum 7. The port 11 is co-axial with the axis 3A and is in the form of a bore extending through a boss 13 that projects from the upper wall 12 of the drum within the secondary chamber 10.

Following fitting of the insert 6 in the open topped container, a plastics tube 15, pre-cut to length, is inserted (by a probe, not shown) through the open top of the container with a bottom end 16 of the tube moving along the axis 3A so that part length of the tube at its bottom end is received as a press fit and in sealing engagement with the socket which is effectively presented by the bore 11. When fitted to the insert 6, the tube 15 extends within the primary chamber 5 upwardly from the insert towards the open top of the container and so that the upper end 17 of the tube opens into the primary chamber at a considerable distance from the container base 2. It will be seen from the drawing that because the socket 11 is co-axial with the cylindrical wall 3 of the container and the bottom end of the tube 16 is fed into the socket 11 co-axially therewith along the axis 3A, no particular rotational orientation is necessary between the insert 6 and the container side wall to ensure that the socket 11 is appropriately positioned to receive the tube. This is advantageous in a commercial installation where an array of open topped containers are successively fitted with inserts and subsequently tubes fitted successively to the inserts at high speed. Although the bottom end 16 of the tube 15 is fed by the probe into the insert socket 11 along the axis 3A, the tube itself is pre-curved over its length as a shallow arc so that when fitted to the insert the upper end 17 of the tube is located adjacent to and directed towards the side wall 3 as shown in the drawing.

During press fitting of the tube 15 into the socket presented by the bore 11 the upper wall 12 of the hollow drum 7 may flex so that the boss 13 is displaced temporarily to abut the bottom wall 9 of the drum. The tube may be inserted into the full length of the socket 11, possibly until its bottom end 16 abuts the bottom wall 9 of the drum or abuts a small internal flange 13A at the end of the socket 11 on the boss 13 (FIG. 2). Following fitting of the tube and disengagement of its delivery probe, the top wall 12 of the drum may revert to its unflexed condition to withdraw the boss 13 and bottom end 16 of the tube from the bottom wall 9, by this means a predetermined gap 18 may be formed between the bottom end 16 of the tube and the drum wall 9. The gap 18 may serve as a restricted aperture through which the secondary chamber 10 communicates with the tube 15 and therethrough with the primary chamber 5. Furthermore, this latter fitting of the tube to the insert may determine, with reasonable accuracy, the height of the upper end 17 of the tube from the base 2 of the container and thereby, when the container is charged with a predetermined volume of beverage 20, the position of the upper end of the tube with respect to the surface of the beverage.

After the tube 15 has been fitted to the insert, the primary chamber 5 is charged with the beverage 20 containing gas in solution and thereafter the container is closed and sealed by the top 4 so that a primary headspace 21 in the primary chamber of the container is at a pressure greater than atmospheric. Pressurisation of the headspace 21 may be achieved in conventional manner, for example by dosing the primary chamber with liquid nitrogen immediately prior to the top 4 being fitted and sealed.

During charging of the primary chamber 5 with beverage 20 (or during handling, for example inversion, of the beverage package subsequent to sealing) beverage from the primary chamber enters the tube 15 through its upper end 17 and flows through the tube into the secondary chamber 10 (as indicated at 5A) so that when the contents of the sealed container are in equilibrium a secondary headspace 22 is formed within the secondary chamber 10 containing gas at a pressure greater than atmospheric.

When the sealed package is opened, for example by a ring pull (not shown) in the top 4 to dispense the beer 20, the primary headspace 21 is opened to atmospheric pressure and rapidly de-pressurises. As a consequence a pressure differential is developed whereby the pressure of gas in the secondary headspace 22 exceeds the pressure in the headspace 21. This causes the beer 5A in the secondary chamber 10 to be displaced through the gap 18 into the bottom end 16 of the tube to displace beer from the tube by way of its upper end 17 and froth or foam to develop as gas is liberated from the beer. It will be noted that the bottom end 16 of the tube 15 and/or the boss 13 opposes and projects into a small recess 23 in the bottom wall 9 of the hollow body 7. The gap 18 is formed in the recess 23 and this recess conveniently serves as a sump within which an insignificant volume of beer may be retained (following ejection of the beer 5A from the secondary chamber into the primary chamber) to minimise wastage of beer within the insert 6.

The upper end 17 of the tube 15 may communicate directly with the headspace 21 when the container is opened so that froth which emerges from the tube 15 will float on the beverage in the primary headspace 21. Alternatively the upper end 17 of the tube may be submerged within the beverage 5 in the primary chamber so that when the container is opened, the fluid emerging from the tube into the upper part of the beverage in the primary chamber initiates further evolution of gas from the beer in the primary chamber 5 which is at a level above the top opening of the tube 15 to cause the development of froth or foam in the headspace 21. The tube therefore provides an isolating effect to the gas evolution which is initiated from the beer when the container is opened and a considerable proportion of the volume of the beer within the container will retain gas, particularly carbon dioxide, in solution. Therefore when the beer is poured from the container into a drinking glass shortly after opening the can, the froth developed by the evolution of gas from part only of the beverage may provide a desirable head on the beer in the glass. However adequate gas can be maintained in solution in the beer in the glass for such gas to evolve gradually and naturally and present a slight effervescent effect or "sparkle" to the body of the beer—this is considered most desirable for aesthetic quality in lager or light beer and may also enhance the flavour characteristics and mouth feel of the beer.

Gas in solution is liberated from the beer for the purpose of froth development in the example of FIG. 1 by passing the beer which flows from the secondary chamber into the primary chamber (as a result of the pressure differential caused by opening of the container) through a restriction. This restriction may be provided by having a relatively small diameter bore for the tube 15. Alternatively, or in addition, the restriction may be formed by a restricted aperture presented by the gap 18 through which beer 5A from the secondary chamber flows to be injected into the column of beer contained in the tube 15. In this latter case the evolution of gas may be initiated in the bottom end of the tube and rapidly grow to rise throughout the beer within the tube for a fluid mixture which may comprise beer, gas and froth to be displaced from the upper end of the tube.

In a typical example the primary chamber 5 may accommodate, say, 440 milliliters of the beer to form a primary headspace 21 of 5% to 15% of the capacity of the container 1. In the sealed package the primary headspace 21 may be pressurised with nitrogen gas, typically to a pressure in the range of 1.5 to 3 atmospheres. The secondary chamber 10 may have a volume of 16 milliliters and the pipe 15 a bore diameter in the range of 0.2 to 3.0 millimeters. The gap 18 is approximately in the range 0.5 to 2.0 millimeters.

When the package is opened it will be apparent that fluid comprising beer, foam and/or gas ejected from the tube 15 may be jetted from the upper end of the tube, particularly if that upper end is located within the headspace 21. By positioning the upper end 17 of the tube adjacent to the side wall 3 of the container, preferably so that the tube is directed towards the side wall, the possibility is alleviated of beverage or foam being jetted from the tube through the aperture which is formed by opening the top 4.

Figure 3:
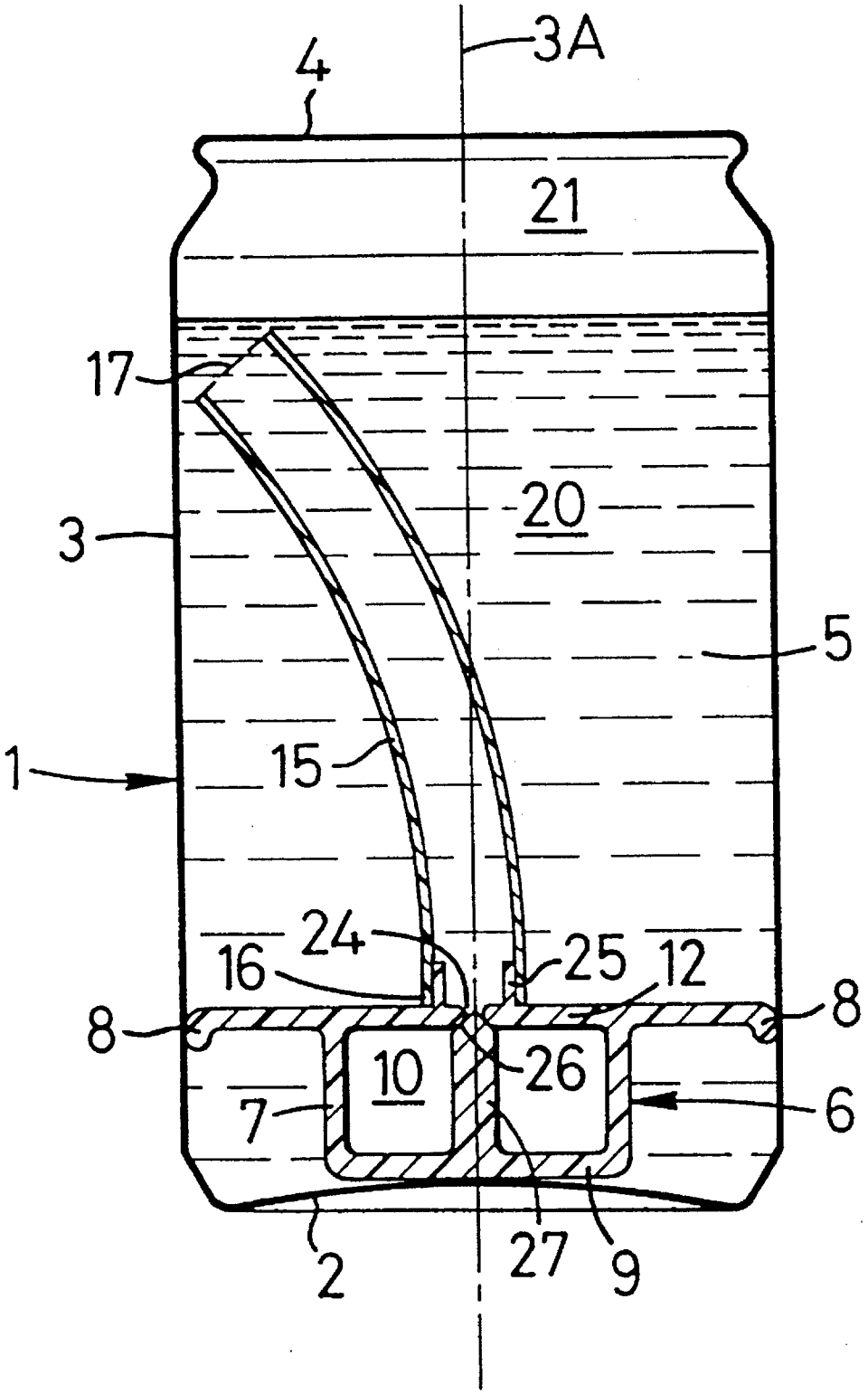
FIG. 3 shows a section through the second embodiment of the package in which the tube is fitted on a spigot seating of the secondary chamber.

In the embodiment of FIG. 3 the insert 6 as fitted to the bottom of the primary chamber 5 has its secondary chamber 10 sealed and containing gas, typically nitrogen gas, at a pressure greater than atmospheric. The top wall 12 of the drum has a port 24 located within a cylindrical tubular spigot 25 formed integral with the wall 12 and projecting upwardly into the primary chamber co-axial with the axis 3A. The port 24 is closed to seal the secondary chamber 10 by a nose 26 of a peg 27 in the secondary chamber. The peg 27 is formed integral with the bottom wall 9 of the insert drum 7. The tube 15 is fitted to the insert by displacing its lower end 16 along the axis 3A in the primary chamber for that lower end to be received as a sealing press fit on the spigot 25. After fitting the pipe 15, the primary chamber 5 is charged with beer 20 and the top 4 fitted to seal the container and pressurise the primary headspace 21 similarly to the first embodiment. The sealed package is now processed to ensure that when the top 4 is opened to dispense the beverage, gas from the secondary chamber 10 will be injected automatically through the port 24 into the pipe 15 in response to the pressure differential that is developed between atmospheric pressure in the primary headspace 21 and the greater pressure in the secondary chamber 10. In a known form of insert having an initially sealed secondary chamber, the aforementioned processing comprises heating the plastics of the insert, for example during pasteurisation of the beer in the sealed package, whereby the characteristics of the insert change to the extent that the nose 26 co-operates with the port 24 and top wall 12 to form a non-return valve which is responsive to the aforementioned pressure differential. The non-return valve presented by the nose 26 normally restrains beer from entering the secondary chamber 10 through the port 24. On opening of the container and with the beer in the tube 15, the top wall 12 flexes in response to the pressure differential that is developed to open the port 24 from the nose 26; as a result gas under pressure from the secondary chamber 10 is injected through the port 24 into beer in the pipe 15 or to expel beer from the pipe and thereby liberate gas in solution from the beer to develop a froth in the primary headspace 21. The upper end 17 of the pipe may be submerged in beer 20 in the primary chamber or located in the primary headspace.

By a modification of the embodiment shown in FIG. 3, the pipe 15 can have a capilliary bore so that a negligible amount, if any, beer is present in the pipe. With this modification, when the container is opened gas can be injected from the secondary chamber 10, by way of the port 24 and capilliary bore of the tube 15, directly into the beer 20 in the upper part of the primary chamber to liberate gas from solution for the development of froth in the headspace 21. For this latter effect it should be ensured that the upper end 17 of the tube is submerged in beer 20. When using such a capilliary tube 15 it is likely to be more convenient to fit the lower end 16 of the tube so that it is received in a socket on the insert top wall 12 communicating with the port 24.

When it is intended that the upper end 17 of the tube is submerged within the beer 20, the tube may be modified to carry a baffle (such as a shield, plate or mesh indicated at 30 in FIG. 1) adjacent to its end 17 which serves to restrain or impede the development or growth of bubble/froth formation within the beer 20 (effected by injection of fluid from the end 17 of the tube into the beer) to a minor proportion of the volume of beer in the primary chamber 5.

We claim:

1. A method of forming a beverage package which comprises providing an open topped container with a primary chamber and a secondary chamber in which the secondary chamber contains gas at a pressure greater than atmospheric which will develop in the secondary chamber, said secondary chamber being formed by a hollow bodied insert located within the primary chamber, the primary chamber opening to the open top of the container, and the insert having a port for providing communication therethrough between said secondary chamber and said primary chamber, said port being located remote from said open top; and said insert having an external socket which communicates with said port; inserting into the primary chamber a tube having a bore which communicates between one open end of the tube and a second open end thereof remote from said one open end and press fitting said one open end of the tube to seal into said socket for communication of said one open end with the secondary chamber through said port, said one open end of said tube having a small diameter bore providing a restriction for fluid flow; arranging the tube to extend upwardly toward the open top to locate said second open end of the tube to open into the primary chamber at a position remote from a bottom of the primary chamber; charging the primary chamber with beverage having gas in solution; sealing the open top of the container to provide a primary headspace therein with a pressure greater than atmospheric while maintaining said second open end of the tube open to communication with said primary chamber, and wherein beverage is arranged to flow from the primary chamber into the secondary chamber to form in the secondary chamber a secondary headspace containing gas at a pressure greater than atmospheric when the contents of the package are in equilibrium so that when the package is opened to the open the primary headspace to atmospheric pressure, a pressure differential develops which causes beverage from the secondary chamber to flow by way of said restriction and said tube into the primary chamber, said restriction causing gas in solution from said beverage in said secondary chamber to evolve therefrom by its flow through said restriction for developing froth for the primary headspace.

2. A method as claimed in claim 1 in which the open topped container is substantially cylindrical and which comprises locating the seating substantially on the longitudinal axis of the cylindrical container and displacing the one end of the tube substantially along the axis of the container into sealing engagement with the seating.

3. A method as claimed in claim 1 which comprises sealing said one end of the tube for communication with the secondary chamber and locating said second end of the tube adjacent to an upstanding side wall of the open topped container.

4. A method as claimed in claim 2 which comprises curving the tube over its longitudinal extent prior to inserting the tube into the primary chamber for said tube to diverge from the axis of the cylindrical container and locate its second end adjacent to the cylindrical wall of the container.

5. A method as claimed in claim 1 which comprises locating the insert in the primary chamber substantially on a base of the open topped container for said port of the insert to be presented towards the top opening of the container.

6. A method as claimed in claim 1 which comprises press fitting said one end of the tube into the socket of the insert and temporarily flexing said insert as a result of said press fitting to displace the socket against said opposing wall part of the insert to determine location of the tube in the socket when said one end of the tube abuts a part of the insert.

7. A beverage package comprising a sealed container having a primary chamber containing beverage having gas in solution therewith and forming a primary headspace comprising gas at a pressure greater than atmospheric; a hollow bodied insert forming a secondary chamber containing beverage having gas in solution therewith and gas at a pressure greater than atmospheric and having an external socket; a tube having a bore which communicates between a one open end of the tube and a second open end thereof remote from said one open end, said one open end of the tube being received as a sealed press fit in said socket for the tube to extend upwardly within the primary chamber so that the second end of the tube opens into communication with the primary chamber at a position remote from a bottom of the primary chamber and to provide for sealed communication between said one open end of the tube and the secondary chamber by way of a port in the insert which communicates with said socket, said one open end of the tube having a small diameter bore providing a restriction for fluid flow whereby the secondary chamber can communicate with the primary chamber by way of said restriction and the tube, and wherein said package is openable to the primary headspace to atmospheric pressure and said opening creates a pressure differential causing beverage in the secondary chamber to be ejected by way of said restriction and tube into the primary chamber, said restriction causing gas in solution from said beverage in said secondary chamber to evolve therefrom by its flow through said restriction for developing froth for the primary headspace.

8. A package as claimed in claim 7 in which the seating is directed towards an openable top of the container and said tube extends from the seating upwardly within the primary chamber towards the primary headspace.

9. A package as claimed in claim 7 in which the sealed container has a substantially cylindrical side wall with a base and openable top and said seating is located substantially on the longitudinal axis of the cylindrical side wall.

10. A package as claimed in claim 7 in which the second end of the tube is located adjacent to a side wall of the container.

11. A package as claimed in claim 9 in which the tube is curved over its longitudinal extent to diverge from said axis of the cylindrical side wall and locate its second end adjacent to the cylindrical side wall.

12. A package as claimed in claim 7 in which the tube carries a baffle adjacent to its second end when that second end is submerged in beverage in the primary chamber, said baffle serving to restrain or impede froth formation within beverage in the primary chamber to a minor proportion of the volume of such beverage.

* * * * *